US010837472B2

(12) United States Patent
Chen et al.

(10) Patent No.: US 10,837,472 B2
(45) Date of Patent: Nov. 17, 2020

(54) HYDRAULIC CYLINDER HEALTH MONITORING AND REMAINING LIFE SYSTEM

(71) Applicant: Caterpillar Inc., Peoria, IL (US)

(72) Inventors: Dayao Chen, Bolingbrook, IL (US); Kalpeshkumar N. Patel, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 336 days.

(21) Appl. No.: 15/902,721

(22) Filed: Feb. 22, 2018

(65) Prior Publication Data

US 2019/0257327 A1 Aug. 22, 2019

(51) Int. Cl.

| | |
|---|---|
| ***F15B 19/00*** | (2006.01) |
| ***F15B 15/28*** | (2006.01) |
| ***E02F 9/00*** | (2006.01) |

(52) U.S. Cl.

CPC ..... *F15B 19/005* (2013.01); *E02F 9/00* (2013.01); *F15B 15/2815* (2013.01); *F15B 2211/6306* (2013.01); *F15B 2211/6313* (2013.01); *F15B 2211/6336* (2013.01); *F15B 2211/6343* (2013.01); *F15B 2211/6656* (2013.01); *F15B 2211/857* (2013.01); *F15B 2211/864* (2013.01); *F15B 2211/865* (2013.01); *F15B 2211/8755* (2013.01)

(58) Field of Classification Search

None

See application file for complete search history.

(56) References Cited

U.S. PATENT DOCUMENTS

| | | | |
|---|---|---|---|
| 4,571,994 | A | 2/1986 | Dickey et al. |
| 5,856,745 | A | 1/1999 | Morgan et al. |
| 7,120,523 | B2 | 10/2006 | Muller |
| 8,100,045 | B2 | 1/2012 | Osborn et al. |
| 8,370,083 | B2 | 2/2013 | Wagner et al. |
| 9,108,689 | B1 | 8/2015 | Shelby et al. |
| 9,128,008 | B2 | 9/2015 | Tabor |
| 9,459,609 | B2 | 10/2016 | Koizumi et al. |

(Continued)

FOREIGN PATENT DOCUMENTS

JP 3062665 B2 5/2000

*Primary Examiner* — Daniel S Larkin

(74) *Attorney, Agent, or Firm* — Miller, Matthias & Hull LLP

(57) ABSTRACT

A monitoring system includes a hydraulic cylinder including a piston movably disposed therein. At least one seal is provided within the hydraulic cylinder. A head end pressure sensor is configured to monitor pressure of a hydraulic fluid in a head space. A rod end pressure sensor is configured to monitor pressure of the fluid in a rod space. A displacement sensor is configured to monitor the position of the piston. A temperature sensor is disposed and configured to monitor the temperature of the hydraulic fluid. An electronic control unit is in communication with the sensors and programmed to in response to receiving pressure signals from the pressure sensors, position signals from the position sensor, and temperature signals from the temperature sensor, determine a wear volume of the at least one seal; and compare the wear volume of the at least one seal to a predetermined threshold wear volume of the at least one seal to determine the remaining useful life of the hydraulic cylinder.

19 Claims, 4 Drawing Sheets

(56) References Cited

U.S. PATENT DOCUMENTS

| | | | | |
|---|---|---|---|---|
| 2016/0340841 | A1 | 11/2016 | Krolnik et al. | |
| 2017/0211600 | A1* | 7/2017 | Smith | F15B 20/005 |
| 2017/0292249 | A1 | 10/2017 | Rees et al. | |
| 2017/0350427 | A1* | 12/2017 | Leinonen | F15B 19/005 |
| 2019/0228637 | A1* | 7/2019 | Chen | F15B 1/24 |

* cited by examiner

HYDRAULIC CYLINDER HEALTH MONITORING AND REMAINING LIFE SYSTEM

TECHNICAL FIELD

The present disclosure relates generally to hydraulic cylinders and, more particularly, relates to health monitoring and remaining component life for hydraulic cylinders.

BACKGROUND

Many heavy equipment machines, such as those used in the construction, agriculture, earth-moving, oil extraction, and mining industries, include hydraulic circuits that utilize hydraulic cylinders. For example, such heavy equipment machines can include implements that are operated through the use of hydraulic cylinders or actuators. The continuous use of the hydraulic cylinders during operation of the heavy equipment machine can cause wear over time. It is desirable to detect the health of the hydraulic cylinder in order to schedule maintenance and plan for machine inoperability.

Some prior techniques required physically connecting a pressure gauge to the hydraulic system of a machine, when the heavy equipment machine is stopped and the fluid in the hydraulic system is not pressurized, in order to detect the health of the hydraulic cylinder. While effective, this technique presented challenges when the hydraulic cylinder was positioned in a location that was difficult to access.

In efforts to reduce down time of the heavy equipment machines during health detection, some more current techniques collect data from hydraulic devices while in the field. For example, U.S. Pat. No. 7,120,523 ('523 patent) discloses the utilization of operating parameters of hydraulic cylinders for predicting service intervals. While the '523 patent monitors piston travel distance, pressure and temperature of the working fluid, the monitoring of additional parameters of the hydraulic cylinders can provide more accurate and real-time measurements. Accordingly, improvements in the monitoring of hydraulic cylinder health, performance, and remaining useful life continue to be sought.

SUMMARY

In accordance with an aspect of the disclosure, a system for monitoring a hydraulic cylinder is provided. The hydraulic cylinder includes a cylinder barrel. A piston is movably disposed in the cylinder barrel and separates the cylinder into a head space and a rod space. At least one seal is associated with the piston. A pressure sensor is disposed in the head space or any connected space between the cylinder head space and the hydraulic control valve and is configured to monitor pressure of a hydraulic fluid in the head space. A pressure sensor is disposed in the rod space or any connected space between the cylinder rod space and the hydraulic control valve and is configured to monitor pressure of a fluid in the rod space. A displacement sensor is disposed in the barrel and is configured to monitor the position of the piston. A temperature sensor is disposed in the barrel or any connected space in the hydraulic system and is configured to monitor the temperature of the fluid. An electronic control unit including an algorithm is in communication with the head end sensor, the rod end sensor, the displacement sensor and the temperature sensor. The algorithm of the electronic control unit is programmed to: responsive to receiving pressure signals from the head end and rod end pressure sensors, a piston position signal for the displacement sensor, and a temperature signal from the temperature sensor determine a wear volume of the at least one seal; and compare the wear volume of the at least one seal to a predetermined threshold wear volume of the at least one seal to determine the remaining useful life of the hydraulic cylinder.

In accordance with another aspect of the disclosure, a system for wirelessly communicating health and remaining useful life of a hydraulic cylinder is provided. The system includes a machine including a hydraulic system. A hydraulic circuit is operatively coupled to the hydraulic system. A hydraulic cylinder is fluidly coupled to the hydraulic circuit. A piston is movably disposed in the hydraulic cylinder. At least one seal is associated with the piston. An electronic control unit including an algorithm is in communication with the hydraulic circuit and the hydraulic cylinder. The algorithm of the electronic control unit is programmed to: determine the remaining useful life of the hydraulic cylinder based on comparing a wear volume of the at least one seal to a predetermined threshold wear volume of the at least one seal; and responsive to determining the remaining useful life of the hydraulic cylinder, wirelessly transmit the remaining useful life of the hydraulic cylinder.

In accordance with yet another aspect of the disclosure, a method for monitoring health and remaining useful life of a hydraulic cylinder is provided. The method includes monitoring pressure of hydraulic fluid disposed in a head end and rod end of the hydraulic cylinder, monitoring a position of a piston disposed in the hydraulic cylinder and monitoring temperature of hydraulic fluid disposed in the hydraulic cylinder. The method further includes determining a wear volume of at least one seal associated with the piston of the hydraulic cylinder calculated from the pressure of the head end and rod end fluids, the piston position and the temperature of the fluid. Additionally, the method includes comparing the wear volume of the at least one seal to a predetermined threshold wear volume of the at least one seal to determine the remaining useful life of the hydraulic cylinder; comparing the remaining useful life of the hydraulic cylinder with a predetermined remaining useful life threshold; and displaying an alert responsive to determining the remaining useful life of the hydraulic cylinder is less than the predetermined remaining useful life threshold.

These and other aspects and features of the present disclosure will be more readily understood upon reading the following detailed description when taken in conjunction with the accompanying drawings. Aspects of different embodiments herein described can be combined with or substituted by one another.

It is to be noted that the appended drawings illustrate only typical embodiments and are therefore not to be considered limiting with respect to the scope of the disclosure or claims. Rather, the concepts of the present disclosure may apply within other equally effective embodiments. Moreover, the drawings are not necessarily to scale, emphasis generally being placed upon illustrating the principles of certain embodiments.

DETAILED DESCRIPTION

Figure 1:
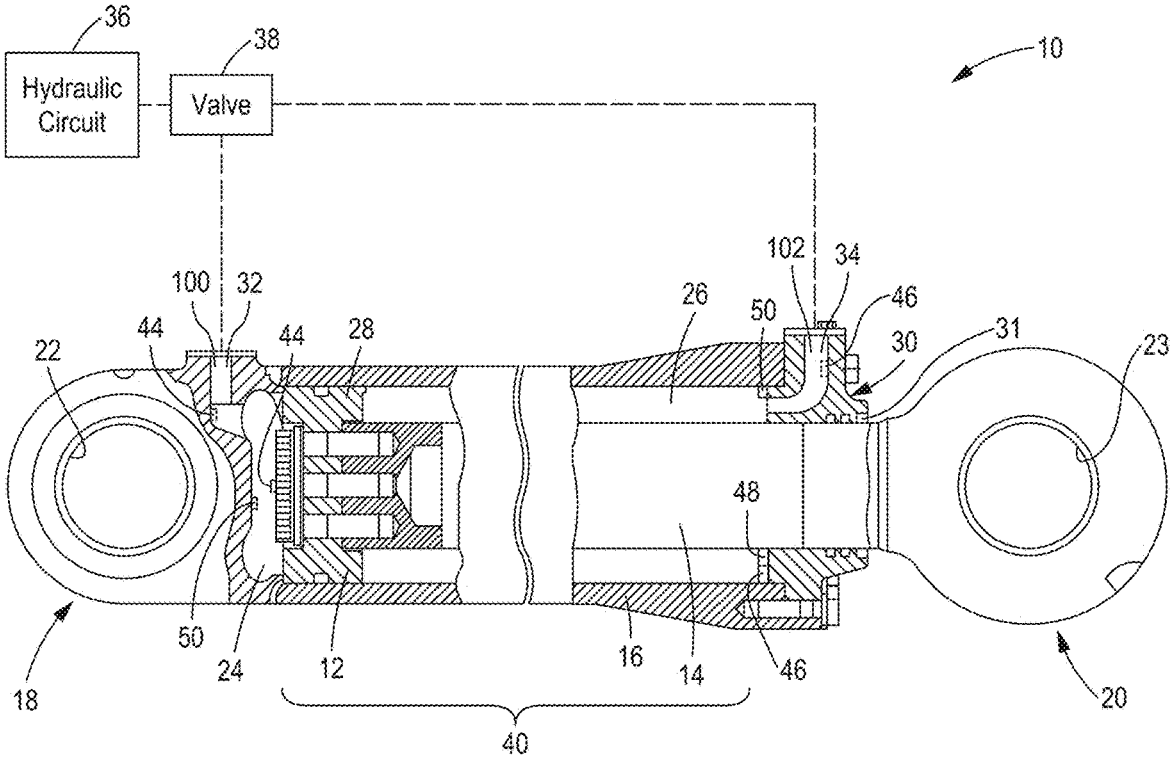
FIG. 1 is a diagrammatic, cross-sectional view of a hydraulic cylinder, in accordance with an embodiment of the present disclosure.

Referring now to FIG. 1, an exemplary hydraulic cylinder constructed in accordance with the present disclosure is generally referred to by reference numeral 10. The hydraulic cylinder 10 includes a piston 12 and connected to a rod 14, both of which are adapted to reciprocate in a cylinder barrel 16. The hydraulic rod includes a head end (HE) 18 and a rod end (RE) 20 which includes head aperture 22 and rod aperture 23, respectively. The space defined by the head end 18 and piston 12 is referred to as a head space 24, while the space defined by the rod 14 and cylinder barrel 16 is referred to as rod space 26. In order to seal the head space 24 from the rod space 26 a piston seal 28 is provided around the piston 12 and proximate the cylinder barrel 16. Similarly, to seal the rod space 26 from the environment a rod seal 30 is provided around the rod 14 and proximate the rod end 20 of the cylinder barrel 16. A wiper 31 is also provided to seal the cylinder 10.

In operation, the piston 12 is caused to move one direction or the other within the barrel 16 in order to perform useful work depending on the machinery to which the cylinder 10 is attached. The piston 12 is caused to move by introduction and evacuation of hydraulic fluid from the head space 24 and rod space 26. More specifically, it will be noted that a first port 32 is in communication with the head space 24 and a second port 34 is in communication with the rod space 26. Pressurized hydraulic fluid provided by a hydraulic piston pump, accumulator, or the like is in communication with the ports 32 and 34 and enables ingress and egress of hydraulic fluid to both. In so doing, if hydraulic fluid is introduced to the head space 24 and removed from the rod space 26, the piston 12 is caused to move to the right (in FIG. 1) and conversely if hydraulic fluid is introduced to the rod space 26 and removed from the head space 24, the piston is caused to move to the left (in FIG. 1). A hydraulic circuit 36 may include hydraulic components (not shown) which are well known in the industry such as, but not limited to, one or more control valves, one or more hydraulic actuators, at least one pump fluidly coupled to a hydraulic fluid reservoir and any other such components consistent with a hydraulic circuit.

The hydraulic circuit 36 may thus be configured to pump or otherwise transport the hydraulic fluid from hydraulic circuit 36 into the head space 24 and rod space 26 of the hydraulic cylinder 10 via the ports 32, 34. In some embodiments, a valve 38 is configured as a two-position, one-way valve including an open position and a closed position to assist in doing so. When the valve 38 is selectively moved to the closed position, the valve 38 is capable of removing fluid from the head space 24 and introducing the hydraulic fluid into the rod space 26. On the other hand, when the valve 38 is selectively moved to the open position, the hydraulic fluid is caused to leave the rod space 26 and enter the head space 24. As a result, during operation the fluid levels within the head space 24 and rod space 26 may each be increased or decreased to define an operational travel range 40 of the piston 12. As used herein, the operational travel range 40 refers to the desired travel displacement of the piston 12 during operation of the hydraulic cylinder 10.

Figure 2:
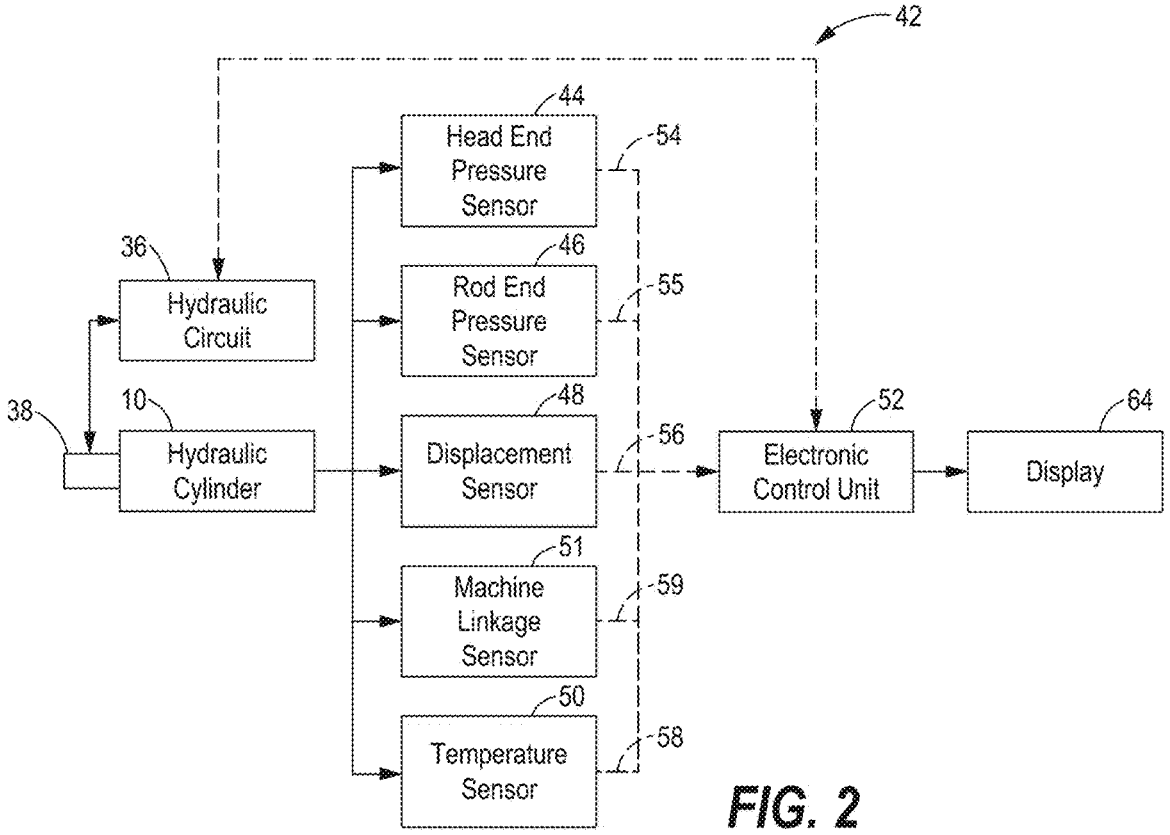
FIG. 2 is a block diagram of an exemplary system for monitoring health and remaining life of an hydraulic cylinder, in accordance with an embodiment of the present disclosure.

FIG. 2 illustrates one non-limiting example of a system 42 capable of monitoring the health and remaining useful life of the hydraulic cylinder 10. The hydraulic cylinder 10 is in communication with a head end pressure sensor 44, a rod end pressure sensor 46, a displacement sensor 48, and a temperature sensor 50. In some embodiments, the displacement sensor 48 may be a position sensor. Also in some embodiments, as shown in FIG. 1, head end pressure sensor 44 may be disposed in the head space 24 of the hydraulic cylinder 10 and is configured to monitor and measure the pressure of the fluid in the head space 24. Alternatively, in some embodiments, the end pressure sensor 44 may be disposed in a first connected space 100 between the head space 24 and the valve 38. An example of suck an alternative disposition of the head end pressure sensor 44 may also be seen in FIG. where the head end pressure sensor 44 is shown in broken line. The rod end pressure sensor 46 may be disposed in the rod space 26 of the hydraulic cylinder 10 and is configured to monitor and measure the pressure of the hydraulic fluid in the rod space 26. Alternatively, in some embodiments, the rod end pressure sensor 46 may be disposed in a second connected space 102 between the rod space 26 and the valve 38. An example of such an alternative disposition of the rod end pressure sensor 46 may also be seen in FIG. 1 where the rod end pressure sensor 46 is shown in broken line. The displacement sensor 48 may be disposed in the barrel 16, for example in the rod space 26, and be configured to monitor and measure the movement and/or position of the rod 14 or piston 12. In some embodiments, the temperature sensor 50 may be disposed in the head space 24 (as shown in the broken line in FIG. 1) and is configured to monitor and measure the temperature of the hydraulic fluid. Alternatively, an embodiment of the hydraulic cylinder 10 may include the displacement sensor 48 disposed in the head space 24 to monitor and measure the position of the piston 12. Another embodiment of the hydraulic cylinder 10 may include the temperature sensor 50 in the rod space 26 see FIG. 1) to monitor and measure the temperature of the hydraulic fluid. In a further embodiment, in lieu of the displacement sensor 48, a machine linkage sensor 51 can be provided and cylinder displacement can be calculated based on machine linkage positions.

Furthermore, the head end pressure sensor 44, the rod end pressure sensor 46, the displacement sensor 48, and the temperature sensor 50 are all in communication with an electronic control unit 52. The electronic control unit 52 is configured to receive and process a head end pressure signal 54 and a rod end pressure signal 55 from the head end pressure sensor 44 and the rod end pressure sensor 46, respectively. Additionally, the electronic control unit 52 is configured to receive and process a piston position signal 56 and a temperature signal 58 from the displacement sensor 48 and temperature sensor 50, respectively. Alternatively, if a machine linkage sensor 51 is used, the electronic control unit would be configured to receive and process a machine linkage signal 59 from the machine linkage sensor 51. The monitoring system 42 is a dynamic system such that the electronic control unit 52 is configured to monitor current status, operation, performance, health, and remaining useful life of the hydraulic cylinder 10 via, in part, dynamic, real-time feedback of the pressure signals 54, 55 and the position, temperature or machine linkage signals 56, 58, 59. The electronic control unit 52 of the monitoring system 42 is configured to, in response to receiving and processing pressure signals 54, 55 and the position, temperature or machine linkage signals 56, 58, 59 determine the health and remaining useful life of the hydraulic cylinder 10. As discussed in more detail below, in an embodiment, an algorithm inside the electronic control unit 52 is programmed to collect, store, analyze and perform other such functions on the data collected in order to help monitor the overall health and remaining useful life of the hydraulic cylinder 10.

In particular, the electronic control unit 52 is configured to calculate the wear volume W of one or all seals, namely piston seal 28, rod seal 30 and wiper 31, which is a factor in measuring and determining the life of the hydraulic cylinder 10. As a method of computation, it may be useful to target on the leakage failure due to the seal failure, including wiper, rod seal, and the piston seal. If one of wiper, rod seal, or piston seal fails, the cylinder will be categorized as a seal failure, and required service will be performed.

$$W = k\frac{P_n S}{H} = cP_n S$$

The volume of the material removed (W) is proportional to the sliding distance (S), the normal pressure (Pn) and the dimensionless wear coefficient (k), and inversely proportional to the hardness of the surface being worn away (H). Assume that $$c = \frac{k}{H} \text{ and wear} \propto (P_n, S)$$

The pressure at rod end and head end may be measured through pressure sensors, the travel displacement may be measured through a displacement sensor, and the velocity may be measured through a sensor or calculated based upon displacement sensor values.

Wiper:

$P_n$=1 (no pressure to the wiper)

Rod Seals:

$P_n = P_{re}$

Piston Seals:

$P_n = |P_{he} - P_{re}|$

The volume of wear may be expressed as follows:

The volume of seal wear:

Wiper $$W = k\frac{P_n S}{H} = c \cdot S$$

$$\rightarrow W = \int c \cdot \text{Velocity} \cdot dt$$

Rod seals $$W = k\frac{P_n S}{H} = cP_{re} \cdot S$$

-continued $$\rightarrow W = \int cP_{re} \cdot \text{Velocity} \cdot dtc$$

Piston seals $$W = k\frac{P_n S}{H} = c|P_{he} - P_{re}| \cdot S$$

$$\rightarrow W = \int c|P_{he} - P_{re}| \cdot \text{Velocity} \cdot dt$$

During operation of the hydraulic cylinder 10 in the field, the electronic control unit 52 of the monitoring system 42 monitors and receives in real-time the pressure signals 54, 55 and the position and temperature signals 56, 58 (or machine linkage signal 59) to calculate the wear volume W of the at least one seal 28, 30, 31, of the hydraulic cylinder 10. The electronic control unit 52 calculates the wear volume W via the following equation:

Outputs from the Practical/Machine Data

Total cylinder travel/wiper $W_{wiper} = \Sigma(W_0, W_{90}, W_p, W_{p_90})$ $W_0 = \Sigma S_0$ below 90° C. oil temperature $W_{90} = \Sigma S_{90}$ above 90° C. oil temperature $W_p = \Sigma S_{300}$ above 300 bar pressure $W_{p_90} = \Sigma S_{300_90}$ above 300 bar AND above 90° C.

Total Product of wear for Rod seal $W_{rod} = \Sigma(W_{0_rod}, W_{90_rod}, W_{p_rod}, W_{p_rod_90})$ $W_{0_rod} = \int P_{re} \cdot \text{Velocity} \cdot dt$ below 90° C. oil temperature $W_{90_rod} = \int P_{re} \cdot \text{Velocity} \cdot dt$ above 90° C. oil temperature.

$W_{p_rod} = \int P_{re} \cdot \text{Velocity} \cdot dt$ when $P_{re}$>300 bar $W_{p_rod_90} = \int P_{re} \cdot \text{Velocity} \cdot dt$ when $P_{re}$>300 bar AND above 90° C.

Total Product of wear for Piston Seal $W_{piston} = \Sigma(W_{0_piston}, W_{90_piston}, W_{p_piston}, W_{p_piston_90})$ $W_{0_piston} = \int |P_{he} - P_{re}| \cdot \text{Velocity} \cdot dt$ below 90° C. oil temperature $W_{90_piston} = \int |P_{he} - P_{re}| \cdot \text{Velocity} \cdot dt$ above 90° C. oil temperature $W_{p_piston} = \int |P_{he} - P_{re}| \cdot \text{Velocity} \cdot dt$ when $P_{he}$ or $P_{re}$>300 bar $W_{p_piston_90} = \int |P_{he} - P_{re}| \cdot \text{Velocity} \cdot dt$ when $P_{he}$ or $P_{re}$>300 bar AND above 90° C.

$$\text{The remaining useful life} = \frac{W_{total} - W}{W_{total}}$$

$$\text{Wiper } RUL = \frac{W_{total} - W_{wiper}}{W_{total}}$$

$$\text{Rod seal } RUL = \frac{W_{total} - W_{rod}}{W_{total}}$$

$$\text{Piston seal } RUL = \frac{W_{total} - W_{piston}}{W_{total}}$$

$W_{total}$ for wiper, rod seal, or the piston seal can be defined thru the lab test/seal test (qualification/endurance test)

Figure 3:
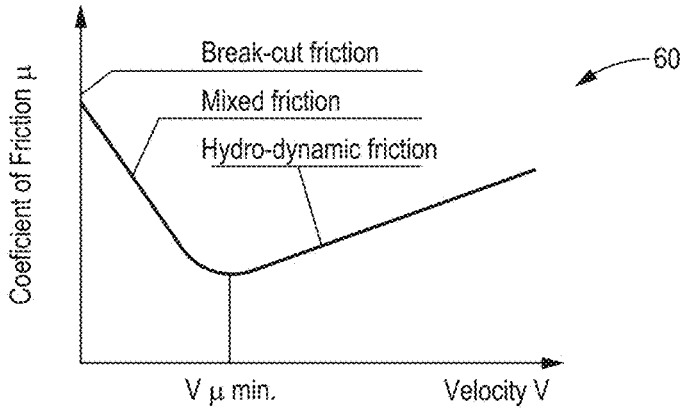
FIG. 3 is a graphical representation of a theoretical Stribeck diagram.
Figure 4:
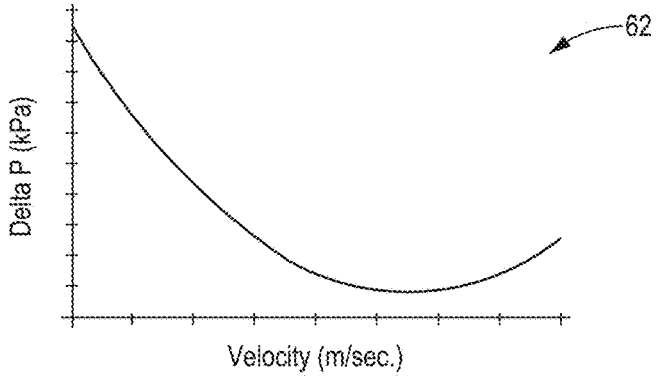
FIG. 4 is a graphical representation of an empirical Stribeck diagram, in accordance with an embodiment of the present disclosure.

Additionally or alternatively, in some embodiments, the electronic control unit 52 of the monitoring system 42 processes and incorporates the results of the at least one seal 28, 30, 31 Stribeck diagram. In some embodiments, the Stribeck diagram of the at least one seal 28 may take into account that the normal pressure and force to the at least one seal 28, 30, 31 will not be the same with different seal velocities. A theoretical Stribeck diagram 60 is illustrated FIG. 3 to show the relationship for the friction coefficient versus velocity. With the ΔP determined, the electronic control unit 52 of the monitoring system 42 is programmed or otherwise configured to process an empirical Stribeck diagram 62, i.e., the relationship for the ΔP versus velocity, which is exemplarily illustrated in FIG. 4, to determine the seal nominal force at any given piston travel velocity. This result is another manner to calculate wear volume W for the at least one seal 28, 30, 31. As such, the electronic control unit 52 is configured to process this W and compare it the predetermined threshold wear volume W or the wear volume W to determine the remaining useful life RUL of the hydraulic cylinder 10.

Further, the algorithm inside the electronic control unit 52 is programmed or otherwise configured to compare a predetermined remaining useful life threshold $RUL_{threshold}$ value stored on the electronic control unit 52 with the calculated remaining useful life RUL in order to monitor the health of the hydraulic cylinder 10. The electronic control unit 52 is configured to display the calculated remaining useful life RUL, via a display 64 (shown in FIG. 2); in a manner that visually contrasts it with the predetermined remaining useful life threshold $RUL_{threshold}$ value. The electronic control unit 52 is further configured to, responsive to determining that the remaining useful life RUL is less than the predetermined remaining useful life threshold $RUL_{threshold}$, output an alert or notification indicating that the hydraulic cylinder 10 requires maintenance. Additionally, with the electronic control unit 52 in communication with the hydraulic circuit 36, the electronic control unit 52 is programmed or otherwise configured to, responsive to determining that the hydraulic circuit 36 requires shut down to prevent any negative effects, shut down the hydraulic circuit 36.

Figure 5:
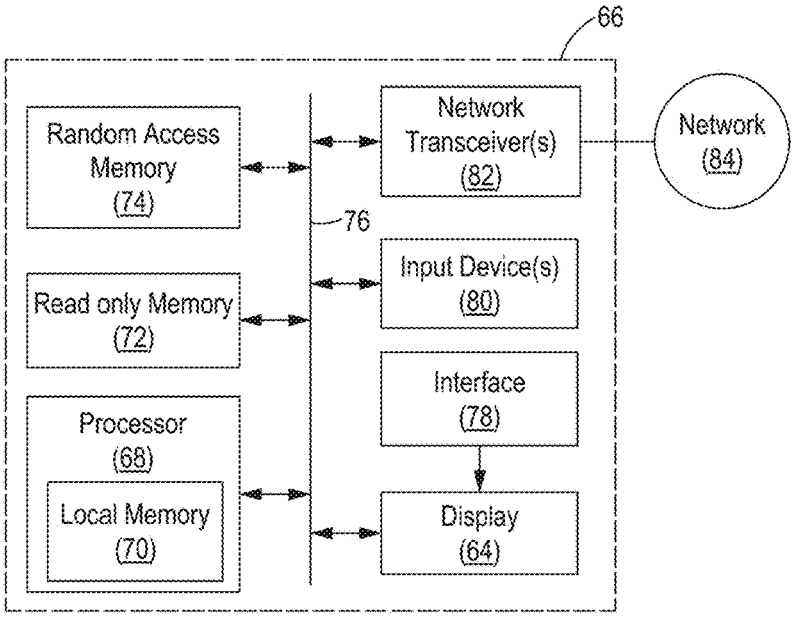
FIG. 5 is block diagram illustrating components of an exemplary electronic control unit, in accordance with an embodiment of the present disclosure.

FIG. 5 is a block diagram of example components of an exemplary computing device 66, such as the electronic control unit 52, capable of executing instructions to realize the disclosed system and methods for monitoring health and remaining life of the hydraulic cylinder 10, as described below and/or capable of executing instructions to perform methods below in reference to FIG. 7. The computing device 66 includes a processor 68 that may be, for example, implemented by one or more microprocessors or controllers from any desired family or manufacturer.

The processor 68 includes a local memory 70 and is in communication with a main memory including a read-only memory 72 and a random access memory 74 via a bus 76. The random access memory 74 may be implemented by Synchronous Dynamic Random Access Memory (SDRAM), Dynamic Random Access Memory (DRAM), RAMBUS Dynamic Random Access Memory (RDRAM) and/or any other type of random access memory device. The read-only memory 72 may be implemented by a hard drive, flash memory and/or any other desired type of memory device.

The computing device 66 may also include an interface circuit 78. The interface circuit 78 may be implemented by any type of interface standard, such as, for example, an Ethernet interface, a universal serial bus (USB), and/or a PCI express interface. One or more input devices 80 are connected to the interface circuit 78 via the bus 76. The input device(s) 80 permit an operator to enter data and commands into the processor 68. The input device(s) 80 may be implemented by, for example, a joystick, a keyboard, a keypad, a touch screen, a mouse, a track-pad, a trackball, and/or a voice recognition system. For example, the input device(s) 80 may include any wired or wireless device for providing input.

A visual display, such as display 64, is also connected to the interface circuit 78 via the bus 76. The display 64 may be implemented by, for example, one or snore display devices for associated data (e.g., a liquid crystal display, a cathode ray tube display (CRT), etc.).

Further, the computing device 66 may include one or more network transceivers 82 for connecting to a network 84, such as the Internet, a WLAN, a LAN, a personal network a satellite network, or any other network for connecting the computing device 66 to one or more other computers or network capable devices. As such, the computing device 66 may be utilized to notify or alert other computing devices of the remaining useful life of the hydraulic cylinder 10.

In some embodiments, the computing device 66 is used to execute machine readable instructions. For example, the computing device 66 may execute machine readable instructions to perform the sample sequence illustrated in flowchart 700 in FIG. 7. In such examples, the machine readable instructions comprise a program for execution by the processor 68. The program may be embodied in software stored on a tangible computer readable medium such as a CD-ROM, a floppy disk, a hard drive, a digital versatile disk (DVD), a Blu-ray™ disk, or a memory associated with the processor 68, but the entire program and/or parts thereof could alternatively be executed by a device other than the processor 68 and/or embodied in firmware or dedicated hardware. Further, although the example programs are described with reference to the flowchart 700 illustrated in FIG. 7, many other methods of implementing embodiments of the present disclosure may alternatively be used. For example, the order of execution of the blocks may be changed, and/or some of the blocks described may be changed, eliminated, or combined.

Figure 6:
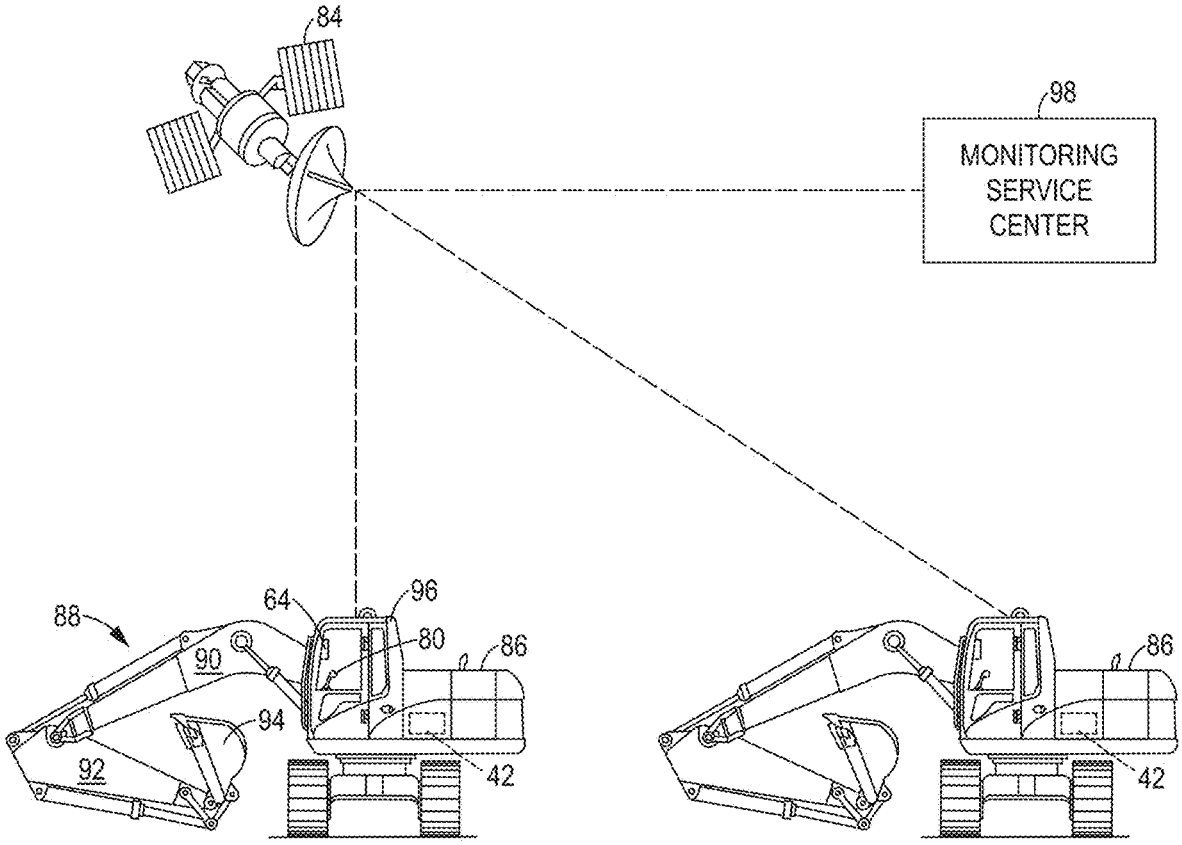
FIG. 6 is schematic diagram illustrating an exemplary system for communicating amongst a fleet of machines and a monitoring service center, in accordance with an embodiment of the present disclosure.

Furthermore, in the exemplary embodiment illustrated in FIG. 6, with continued reference to FIGS. 1 and 2, the hydraulic cylinder 10 and the monitoring system 42 are utilized with the hydraulic circuit 36 of a machine 86. Although the machine 86 is exemplarily depicted as an excavator, it is to be understood that the machine 86 may be any type of machine in the construction, agriculture, earth-moving, oil extraction, and mining industries such as, but not limited to wheel loaders, front shovels, backhoes, track-type tractors, dozers, motor graders, drill stations, or other types of mobile or stationary machines well known in the industries. The machine 86 includes a hydraulic system 88, which is operatively coupled to the hydraulic circuit 36. In particular, the hydraulic circuit 36 is utilized to move various components of the hydraulic system 88, such as, but not limited to, the boom 90, the stick 92, and the implement 94, via control of the input device 80, exemplarily illustrated as a joystick.

With the display 64 disposed in the cab 96 of the machine 86, the electronic control unit 52 displays the calculated remaining useful life RUL in a manner that visually contrasts it with the predetermined remaining useful life threshold $RUL_{threshold}$ value. In addition, responsive to determining that the remaining useful life RUL is less than the predetermined remaining useful life threshold $RUL_{threshold}$, the electronic control unit 52 outputs the alert or notification to the display 64 indicating that the hydraulic circuit 36 requires maintenance. Moreover, responsive to determining that the hydraulic circuit 36 requires shut down to prevent any negative effects, the electronic control unit 52 is configured to shut down the hydraulic circuit 36. In addition to alerting and notifying an operator in the cab 96, the monitoring system 42 is configured to wirelessly transmit, via the network 84, alerts and notifications to other machines within a fleet of machines at a worksite or otherwise, to a monitoring service center 98, and to any other computing device.

INDUSTRIAL APPLICABILITY

In general, the present disclosure may find applicability with monitoring systems for hydraulic cylinders utilized in machines for construction, agriculture, earth-moving, oil extraction, and mining industries. By utilizing the systems and methods disclosed herein, the monitoring system 42 monitors the current status, operation, and performance of the at least one seal 28, 30, 31 of the hydraulic cylinder 10 via, in part, dynamic, real-time feedback of the pressure signals 54, 55 and the position, temperature or machine linkage signals 56, 58, 59 to determine and display the health and remaining useful life of the hydraulic cylinder 10. As a result, the electronic control unit 52 of the monitoring system 42 can output alerts and/or shut down the hydraulic circuit 36 to prevent any negative effects on the hydraulic circuit 36 and/or other components of the machine 86. Moreover, the electronic control unit 52 of the monitoring system 42 can transmit, via the network 84, the dynamic, real-time feedback to other machines within the fleet or to a monitoring service center 98, as well as, transmit alerts and notifications related to the hydraulic cylinder 10.

In operation, the electronic control unit 52 monitors the dynamic, real-time health and performance of the at least one seal 28, 30, 31 via the head end and rod end pressure signals 54, 55 received from head end pressure sensor 44 and the rod end sensor 46, the position and temperature signals 56, 58 received from the position sensor 48, and the temperature sensor 50 (or, in the alternative embodiment referenced above, the machine linkage signal 59 from machine linkage sensor 51). In particular, responsive to receiving the signals 54, 55, 56, 58, 59 the electronic control unit 52 calculates the wear volume W of the at least one seal 28, 30, 31 of the hydraulic cylinder 10. With the wear volume W calculated, the electronic control unit 52 determines the remaining useful life RUL of the hydraulic cylinder 10 by comparing the wear volume W with the predetermined threshold wear volume $W_{PT}$ that is stored in the electronic control unit 52.

The electronic control unit 52 then outputs the remaining useful life RUL to the display 64 in such a manner that visually contrasts it with the predetermined remaining useful life threshold $RUL_{threshold}$ value stored on the electronic control unit 52. Moreover, the electronic control unit 52 also can output for display, via the network 84, the remaining useful life RUL in a similar manner to other machines within the fleet or to the monitoring service center 98. Further, the electronic control unit 52 compares the remaining useful life RUL to the predetermined remaining useful life threshold $RUL_{threshold}$ value to determine whether the remaining useful life RUL is less than the predetermined useful life threshold $RUL_{threshold}$. If the electronic control unit 52 determines this is true, then it outputs an alert or notification indicating that the hydraulic cylinder 10 requires maintenance. The alert or notification can be output to the display 64, another machine in the fleet, and/or to the monitoring service center 98.

Figure 7:
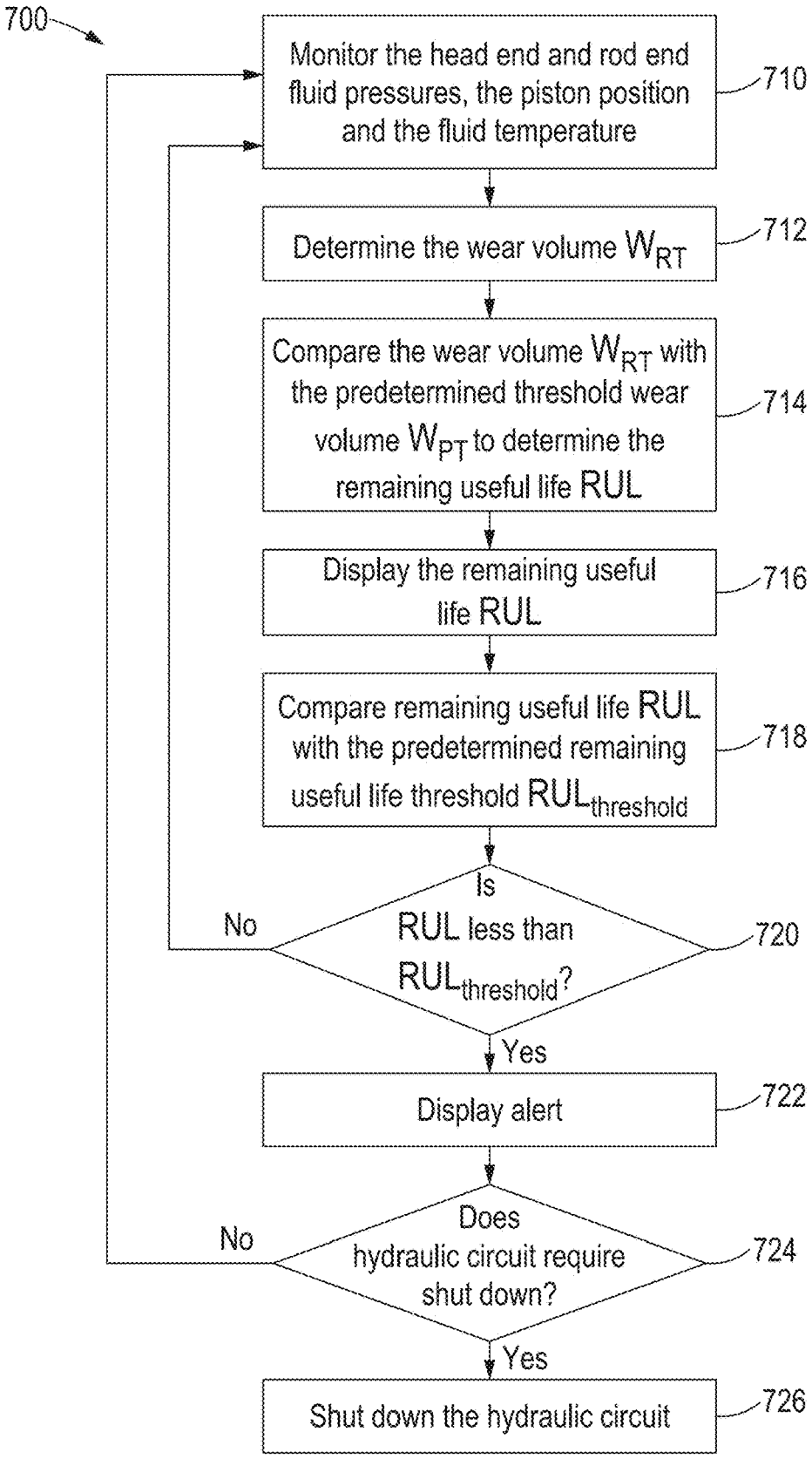
FIG. 7 is a flow chart illustrating a sample sequence which may be practiced in accordance with the teachings of the present disclosure.

FIG. 7 illustrates a block diagram 700 of a sample sequence which may be performed to monitor the health and remaining useful life of a hydraulic cylinder. As illustrated in block 710, the electronic control unit 52 of the monitoring system 42 monitors and measures the pressure of the hydraulic fluid in the head space 24 via the head end pressure sensor 44, the pressure of the second fluid 20 in the rod space 26 via the rod end pressure sensor 46, the piston position of the first piston 12 via the piston displacement sensor 48, and the temperature of the fluid in the rod space 26 via the temperature sensor 50. The electronic control unit 52 then determines the wear volume W, as depicted in block 712. Moving to block 714, the electronic control unit 52 compares the wear volume W with the predetermined threshold wear volume $W_{PT}$ to determine the remaining useful life RUL of the hydraulic cylinder 10. As depicted in block 716, the electronic control unit 52 displays the remaining useful life RUL of the hydraulic cylinder 10 on the display 64 and/or similarly to other machines within the fleet or to the monitoring service center 98.

The block 718 depicts the electronic control unit 52 comparing the remaining useful life RUL of the hydraulic cylinder 10 with the predetermined remaining useful life threshold $RUL_{threshold}$ value stored in the electronic control unit 52. As depicted in decision block 720, the electronic control unit 52 determines whether the remaining useful life RUL of the hydraulic cylinder 10 is less than the predetermined remaining useful life threshold $RUL_{threshold}$ value. If the electronic control unit 52 determines that the remaining useful life RUL of the hydraulic cylinder 10 is not less than the predetermined remaining useful life threshold $RUL_{threshold}$ value, then monitoring continues as shown by the return arrow to block 710. On the other hand, as illustrated in block 722, if the remaining useful life RUL of the hydraulic cylinder 10 is less than the predetermined remaining useful life threshold $RUL_{threshold}$ value, then the electronic control unit 52 displays the alert or notification to the display 64 and/or similarly to other machines 86 within the fleet or to the monitoring service center 98.

As depicted in decision block 724, the electronic control unit 52 determines whether the remaining useful life RUL of the hydraulic cylinder 10 is well below the predetermined remaining useful life threshold $RUL_{threshold}$ value to require shut down of the hydraulic circuit 36. If no, then the electronic control unit 52 continues monitoring as depicted by the return arrow to block 710. If yes, the electronic control unit 52, responsive to this determination, shut downs the hydraulic circuit 36, as depicted in block 726.

What is claimed is:

1. A system for monitoring a hydraulic cylinder, the system comprising:

a hydraulic cylinder including a cylinder barrel;

a piston movably disposed in the cylinder barrel, the piston separating the cylinder into a head space and a rod space;

at least one seal provided with the hydraulic cylinder;

a head end pressure sensor disposed in the head space or a first connected space between the head space and a hydraulic control valve, the head end pressure sensor configured to monitor pressure of a hydraulic fluid in the head space;

a rod end pressure sensor disposed in the rod space or a second connected space between the rod space and the hydraulic control valve, the rod end pressure sensor configured to monitor pressure of the hydraulic fluid in the rod space;

a displacement sensor disposed in the cylinder barrel, the displacement sensor configured to monitor the position of the piston;

a temperature sensor disposed in the hydraulic cylinder, the temperature sensor configured to monitor the temperature of the hydraulic fluid; and an electronic control unit including an algorithm, the electronic control unit in communication with the head end pressure sensor, the rod end pressure sensor, the piston displacement sensor and the temperature sensor, the algorithm of the electronic control unit programmed to:

responsive to receiving pressure signals from the head end and the rod end pressure sensors, a position signal from the displacement sensor, and a temperature signal from the temperature sensor, determine a wear volume of the at least one seal, and compare the wear volume of the at least one seal to a predetermined threshold wear volume of the at least one seal to determine a remaining useful life of the hydraulic cylinder.

2. The system of claim 1, further including a selectively controlled valve operatively coupled to the hydraulic cylinder, wherein when the selectively controlled valve is actuated into a closed position the hydraulic fluid is commuted into the head space from a hydraulic circuit fluidly coupled to the hydraulic cylinder and the hydraulic fluid is removed from the rod space of the hydraulic cylinder.

3. The system of claim 1, further including a display in communication with the electronic control unit, wherein the electronic control unit is configured to output, to the display, the remaining useful life of the hydraulic cylinder.

4. The system of claim 3, wherein the electronic control unit is further configured to output, to the display, the remaining useful life of the hydraulic cylinder in a manner that visually contrasts with a predetermined remaining useful life threshold value.

5. The system of claim 4, wherein the electronic control unit is further configured to, responsive to determining that the remaining useful life is less than the predetermined remaining useful life threshold value, output an alert to the display indicating the hydraulic cylinder requires maintenance.

6. The system of claim 5, wherein the electronic control unit is further configured to, responsive to determining that the remaining useful life is less than the predetermined remaining useful life threshold value and determining that a hydraulic circuit fluidly coupled to the hydraulic cylinder requires shut down, shut down the hydraulic circuit.

7. The system of claim 1, wherein:

instead of the displacement sensor disposed in the cylinder barrel of a hydraulic cylinder disposed on a machine, the system includes a machine linkage sensor disposed on the machine, the machine linkage sensor in communication with the electronic control unit, and cylinder displacement is calculated based on machine linkage positions; and the algorithm of the electronic control unit is further programmed to: responsive to receiving pressure signals from the head end and the rod end pressure sensors, a machine linkage signal from the machine linkage sensor, and a temperature signal from the temperature sensor, determine a wear volume of the at least one seal.

8. A system for wirelessly communicating health and remaining useful life of a hydraulic cylinder, comprising:

a machine including a hydraulic system;

a hydraulic circuit operatively coupled to the hydraulic system;

a hydraulic cylinder fluidly coupled to the hydraulic circuit;

a piston movably disposed in the hydraulic cylinder;

at least one seal associated with the piston; and an electronic control unit including an algorithm, the electronic control unit in communication with the hydraulic circuit and the hydraulic cylinder, the algorithm of the electronic control unit programmed to:

determine a wear volume of the at least one seal responsive to receiving pressure signals from a head end pressure sensor and a rod end pressure sensor disposed in the hydraulic cylinder, and a position signal from a displacement sensor and a temperature signal from a temperature sensor disposed in the hydraulic cylinder, determine the remaining useful life of the hydraulic cylinder based on comparing the wear volume of the at least one seal to a predetermined threshold wear volume of the at least one seal, and responsive to determining the remaining useful life of the hydraulic cylinder, wirelessly transmit the remaining useful life of the hydraulic cylinder.

9. The system of claim 8, wherein the electronic control unit is configured to wirelessly transmit the remaining useful life of the hydraulic cylinder to at least one of:

another machine within a fleet of machines, and a monitoring service center for monitoring the health of the hydraulic cylinder.

10. The system of claim 8, wherein the head end sensor is configured to monitor pressure of hydraulic fluid disposed in a head space of the hydraulic cylinder, the rod end pressure sensor is configured to monitor pressure of hydraulic fluid disposed in a rod space of the hydraulic cylinder, the displacement sensor is configured to monitor position of the piston and the temperature sensor is configured to monitor temperature of the hydraulic fluid.

11. The system of claim 10, further including a selectively controlled valve operatively coupled to the hydraulic cylinder, wherein when the selectively controlled valve is actuated into a closed position the hydraulic fluid is communicated into the head space from the hydraulic circuit fluidly coupled to the hydraulic cylinder and the hydraulic fluid is removed from the rod space.

12. The system of claim 10, wherein the algorithm of the electronic control unit is further programmed to, responsive to determining that the remaining useful life is less than a predetermined remaining useful life threshold value, wirelessly transmit an alert to one of another machine within a fleet of machines and a monitoring service center.

13. The system of claim 12, wherein the electronic control unit is further configured to, responsive to determining that the hydraulic circuit fluidly coupled to the hydraulic cylinder requires shut down based on the determination that the remaining useful life is less than the predetermined remaining useful life threshold value, shut down the hydraulic circuit.

14. A method for monitoring health and remaining useful life of a hydraulic cylinder, the method comprising:

monitoring a pressure of hydraulic fluid disposed in a head space and rod space of a hydraulic cylinder;

monitoring a position of a piston disposed in the hydraulic cylinder;

monitoring a temperature of the fluid disposed in the hydraulic cylinder;

determining a wear volume of at least one seal associated with the piston of the hydraulic cylinder calculated from the pressure of the head end and rod end fluids, the position of the piston and the temperature of the hydraulic fluid;

comparing the wear volume of the at least one seal to a predetermined threshold wear volume of the at least one seal to determine the remaining useful life of the hydraulic cylinder;

comparing the remaining useful life of the hydraulic cylinder with a predetermined remaining useful life threshold; and displaying an alert responsive to determining the remaining useful life of the hydraulic cylinder is less than the predetermined remaining useful life threshold.

15. The method of claim 14, further including transmitting the remaining useful life of the hydraulic cylinder to one of a display disposed on a machine, another machine within a fleet of machines, and a monitoring service center.

16. The method of claim 15, wherein determining the wear volume of the at least one seal is further calculated from a determined travel distance of the piston and the at least one seal.

17. The method of claim 14, further including determining a travel distance of the piston and the at least one seal.

18. The method of claim 14, further including determining that a hydraulic circuit fluidly coupled to the hydraulic cylinder requires shut down based on a determination that the remaining useful life is less than the predetermined remaining useful life threshold value.

19. The method of claim 18, further including communication to an operator and possible shutting down the hydraulic circuit.

* * * * *